United States Patent [19]

Volk et al.

[11] 4,186,337

[45] Jan. 29, 1980

[54] ANALYZER FOR TRANSISTOR IGNITION SYSTEM

[75] Inventors: Richard G. Volk, York, Pa.; Frank J. Muellner, Chicago, Ill.

[73] Assignee: K-D Manufacturing Company, Lansdale, Pa.

[21] Appl. No.: 859,434

[22] Filed: Dec. 12, 1977

[51] Int. Cl.[2] ..... F02P 17/00

[52] U.S. Cl. ..... 324/380; 324/388

[58] Field of Search ..... 324/15, 17, 18, 16 R

[56] References Cited

U.S. PATENT DOCUMENTS

| | | | |
|---|---|---|---|
| 2,648,816 | 8/1953 | Schuch | 324/15 |
| 3,158,804 | 11/1964 | Weissert | 324/15 |
| 3,551,800 | 12/1970 | Widmer | 324/15 |
| 3,979,664 | 9/1976 | Harris | 324/17 |
| 4,101,822 | 7/1978 | Doss et al. | 324/16 R |

*Primary Examiner*—Stanley T. Krawczewicz

*Attorney, Agent, or Firm*—Paul & Paul

[57] ABSTRACT

A simplified, electronic circuitry, testing apparatus for performing voltage, continuity, open circuit or dynamic signal substitution testing of each individual major component within an automotive-type transistor ignition system preferably having a multi-function control for connecting a single pair of test probes to any of various test circuitry subcircuits thereof, a signal generator may be included therein, a plurality of discrete display components integral to the test subcircuits may display test results, this testing apparatus being capable of being powered by the electrical power source for the engine ignition system and preferably containing safety devices for preventing electrical damage to the ignition system under test or to the testing apparatus itself; preferably a separate adapter component and a separate spark indicator component which establishes a precise test spark gap may be connected as part of the testing apparatus.

14 Claims, 5 Drawing Figures

ANALYZER FOR TRANSISTOR IGNITION SYSTEM

BACKGROUND OF THE INVENTION

This invention relates to test apparatus for testing an automotive-type electronic ignition system and more particularly to test circuitry for detecting continuity, open circuit, lack of power and dynamic signal response faults in the various components within a transistor ignition system for a motor vehicle.

With the onset of electronic ignition systems for automobiles, power boats and small engine aircraft, mechanics face evermore severe problems in analyzing, diagnosing and isolating faults in such ignition systems. These new electronic systems have incorporated transistors and microelectronic components to perform functions previously accomplished mechanically or electromechanically. Most mechanics are not generally conversant with such state of the art solid-state electronic systems. Hence, most of them being schooled in prior art electromechanical ignition systems have great difficulty in dealing with the detailed aspects of electronic ignition systems. As ignition systems have become more electronically complex, standard test equipment for diagnostic testing of such systems has become more complex and expensive. However, this equipment which very often includes digital voltmeters, ohmmeters, oscilloscope and sweep pulse generators has not been designed specifically to test such transistor ignition systems. Moreover, the equipment puts out qualitative information which must be interpreted by the user. Very often an engineer instead of a technician or mechanic is required to operate such complex test equipment. Consequently, the expense and complexity of such test equipment has given rise to substantial questions as to the economic practicality of such equipment for the ordinary maintenance garage.

Simple test equipment, designed specifically for transistor ignition sytems, has heretofore not generally been available in the marketplace. In fact, only one such tester for electronic ignition systems has thusfar come to the marketplace. This unit is known as "UNI-TESTER ELECTRONIC IGNITION TESTER" provided by Chrysler Motors Corporation as described in instruction manual CM-923, and further identified by part number P/N 1-3500. As this Chrysler tester is a very recent development, very little is known about its structural configuration. This unit, however, is known to have a number of test circuits including a simulation circuit for performing shunt to ground and continuity tests. The Chrysler unit appears to be complex, having at least eight display lights and a six position function switch for controlling the operation of the tester. Additionally, this Chrysler tester does not appear to contain safety devices for preventing electrical damage to the ignition system under test or the testing apparatus itself other than circuit-breaker type components which open circuit after a finite period of time under short circuit conditions. These circuit-breaker type components require a finite period of time to reset and to render the tester operative again. The Chrysler safety devices are inconvenient as they render the unit inoperative for a fixed reset period of time. More importantly, they are undesirable as they subject the components within the tester and within the ignition system to short circuit conditions for a finite period of time during which such conditions may cause permanent damage to the circuitry of the tester or of the system being tested.

The major automobile manufacturers, American Motors, Chrysler, Ford and General Motors, have recently published shop manuals which teach methods for testing their transistor electronic ignition systems and show the type of equipment utilized. This equipment appears to be as discussed above. Moreover the coil, as taught by these manuals, is not tested as an isolated unit.

The coil has been tested by removing the coil's secondary wire from the distributor cap center tower and then positioning it to provide an air gap between that wire and the engine block. This procedure requires that a technician or mechanic provide a makeshift air gap between the center tower secondary wire of the coil and engine block ground. This test is very imprecise and does not provide a precise air gap test of the spark which would provide a substitute for spark plug operation. A consistant and reproduceable test of spark, i.e., the secondary output from the coil, is not easily obtained.

What is needed, therefore, is a very simple testing apparatus having a minimal number of controls and a minimal number of display components, wherein the testing apparatus is capable of testing each major component within a transistor ignition system to isolate a fault within that component apart from the other components within the ignition system. It is desirable to have such a test apparatus be "fool-proof" whereby the ignition system under test and the testing apparatus itself are protected from damage due to improper connection of test probes regardless of how finitely small the improper connection time period may be. It is important to remember that the transistor micro-component circuits of the ECU may be burned out very easily.

One object of the present invention is to provide electronic ignition system testing apparatus which is compact and portable, relatively inexpensive, and yet which is capable of performing those diagnostic tests needed to isolate the faults generally occurring in such ignition systems.

Another object is to provide a relatively simple testing apparatus amenable to be used in a testing procedure in itemized "cookbook" fashion providing "go", "no-go" output evaluations.

A further object is to provide such testing apparatus which incorporates a precise, separate spark indicator unit.

An even further object is to provide safety devices for preventing electrical damage to the ignition system under test or to the testing apparatus itself without rendering the testing apparatus inactive for any finite period of time.

SUMMARY OF THE INVENTION

The objectives of this invention may be realized in a testing apparatus for automotive-type electronic ignition systems which testing apparatus may incorporate an electronic circuit preferably having a plurality of distinct transistor test subcircuits thereof including a microelectronic chip. Light emitting diode-type devices may be connected as part of the various subcircuits to provide an output "go", "no-go" display function. Diode components provide reverse polarity protection. An external provision may be made for switching from one subcircuit to another in conjunction with a plurality of distinct test operations performed by the testing apparatus circuitry as a single pair of test probes connected thereto are also connected to different points in the ignition system being tested. These test points may be defined to isolate each major component of the ignition system under test and to perform a given test of that component alone. The testing apparatus circuitry may also be connected to the terminals of the auto battery powering the ignition system under test to power the testing apparatus circuitry. A separate spark indicator component may be connected between vehicle ground and the secondary winding tower of the ignition coil of the electronic ignition system under test.

As a preliminary matter, a first switch position within the testing apparatus provides a subcircuit connection wherein a first light emitting diode may be energized as an indication that, with the test probes unconnected, the auto battery leads of the testing apparatus have been connected to the battery terminals with the proper polarity and sufficient voltage has been supplied to the testing apparatus. With this sufficient voltage condition established, the first switch position provides a subcircuit connection wherein the first light emitting diode may be de-energized as an indication that, with the test probes connected across a point of interest, the voltage across that point is nominally equal to the supply voltage. Moreover, this first switch position may also enable a second light emitting diode to be energized in the presence of a continuity, a nominal short circuit condition, between the test probes. A second switch position provides a subcircuit connection wherein the energization of a third light emitting diode may occur in the presence of an isolation condition, a nominal open circuit, between the test probes. A third switch position may provide a subcircuit connection wherein intermittent energization of a fourth light emitting diode occurs when a dynamic voltage signal is supplied by the tester to a component under test.

A separate spark indicator unit may be connected between the secondary winding tower of the ignition coil and vehicle ground to provide a visual and audio indication of a proper spark signal at the coil secondary. This spark indicator may have spaced points mounted within and may include a vented air gap chamber.

DESCRIPTION OF THE DRAWINGS

The advantages and features of this invention will be easily understood from a reading of the following detailed description in connection with the attached drawings in which like reference numerals refer to like components, and in which.

DETAILED DESCRIPTION

Figure 1:
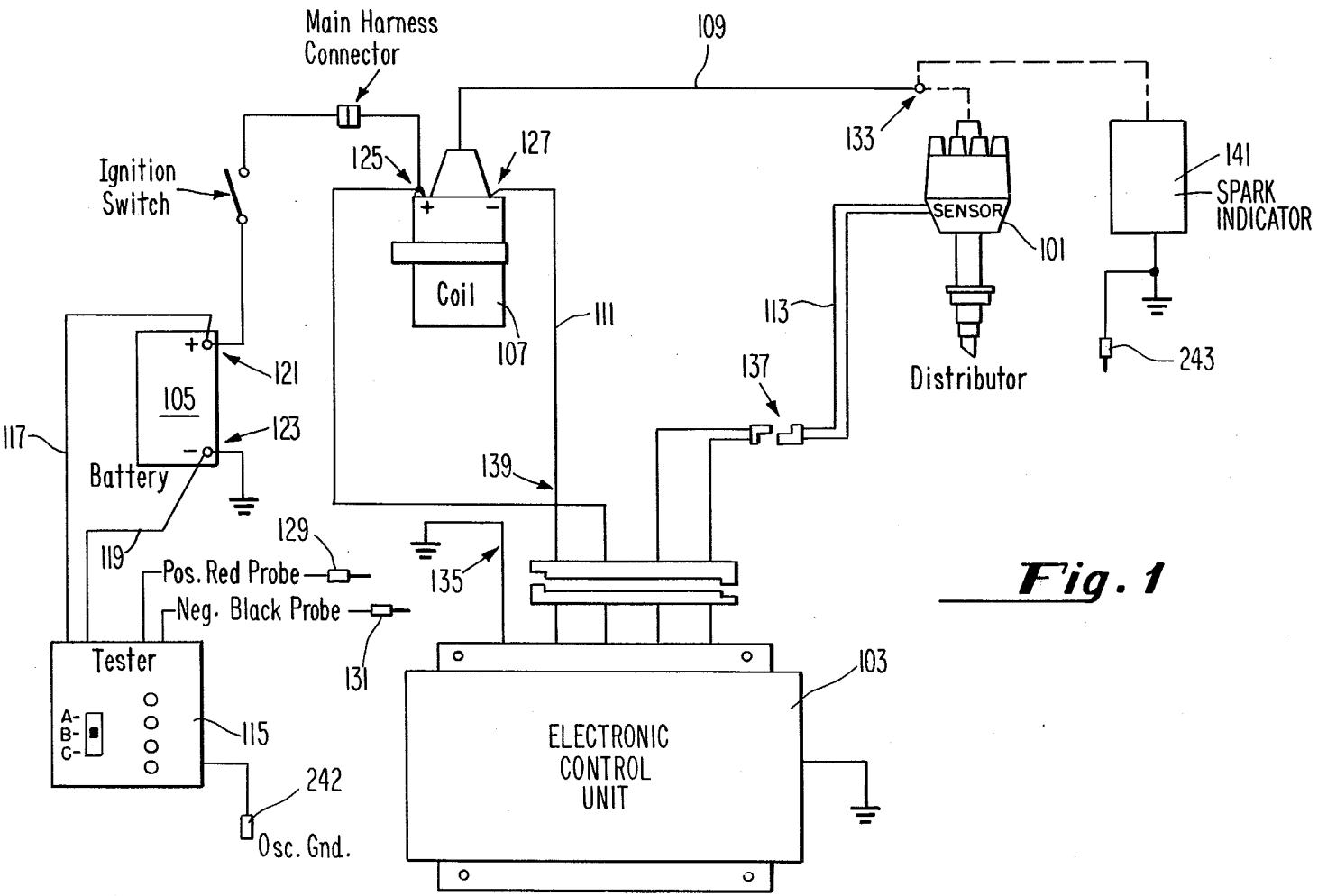
FIG. 1 shows a block diagram representation of a typical auto electronic ignition system illustrating the location of the test points for placement of the test probes of the testing apparatus as well as the connection of the spark indicator component of the testing apparatus.

Modern electronic ignition systems, often called transistor ignition systems, most often comprise five major components. A block representation of such a transistor ignition system, FIG. 1, shows a distributor sensor 101, an electronic control unit (ECU) 103, an input voltage auto battery 105 and an ignition coil 107 with a secondary winding tower wire 109. The heart of such a transistor ignition system is the electronic control unit 103. ECU 103 acts as an electronic switch for controlling the flow of current received from the auto battery 105 through the primary winding of the ignition coil 107 via electrical connection 111 which is the return from the negative terminal of the ignition coil 107. The operation of ECU 103 is triggered by the operation of distributor sensor 101. A signal generated within this distributor sensor 101 via a magneto-type electromagnetic filled component or equivalent is transmitted via sensor signal wire 113 to trigger the operation of a transistor switch within ECU 103 to momentarily open primary winding of the coil 107 by interrupting the current flow of the return connector 111. The momentary collapse of the field of the primary winding is transformed into an impulse on secondary winding and transmitted to the spark plugs via the secondary tower wire 109.

The transistor ignition system of FIG. 1 may be tested by a testing apparatus 115 which may monitor various test points within the electronic ignition system to test the operation of each of the major components thereof. The status at these test points provide an indication of the operational condition of each individual major component.

A first and second test points 117 and 119 is located at the positive and negative terminal of the battery 105. The positive and negative power leads 117 and 119 of the tester 115 are connected to these test points 121 and 123 respectively. A third and fourth test points 125 and 127 is located at the positive and negative terminals of the coil 107. Positive and negative probes 129 and 131 of the tester 115 can be connected across the coil 107 test points 125 and 127. A fifth test point 133 is located at the secondary winding tower of the coil 107.

With the negative probe 131 of the tester connected to ground, assuming a negative to ground hook up for the battery 105, a sixth test point 135 is located at the ground terminal of the ECU 103.

A seventh test point 137 is located on the output signal wire 113 from the sensor 101 to ECU 103; and an eight test point 139 is located on the negative or return connection 111 of the coil 107 to ECU 103.

A spark indicator component 141 is connectable between the secondary winding tower 109 of the coil 107 and ground. Spark indicator component 141 includes an external ground lead and bullet connector 243 on its ground connecting side.

An oscillator ground lead and connector 242 also exits the tester 115. This connector 242 is to be connected to the spark indicator connector 243 as described below.

Figure 2:
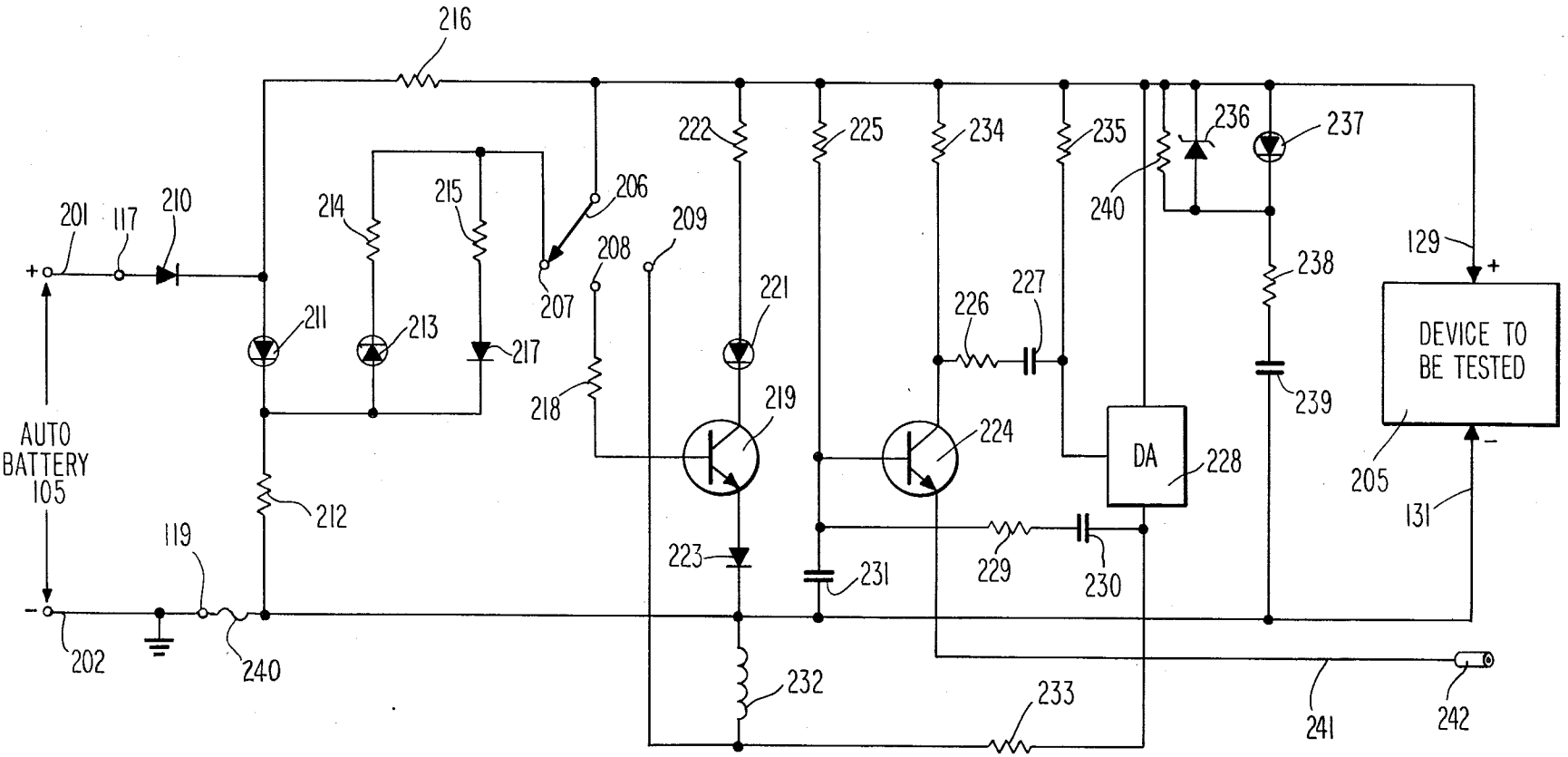
FIG. 2 illustrates the preferred circuitry of an electronic testing apparatus embodying the principles of the present invention.

A circuit diagram, FIG. 2, shows the preferred circuitry comprising the testing apparatus 115 connected to the 12 volt automobile battery 105 having the tester 115 positive power lead 117 connected to the positive terminal 201 and the tester 115 negative power lead 119 connected to the negative terminal 202. Connected into the negative power lead is a fuse 240. The battery 105 is connected with its negative terminal 202 to ground. A first diode 210 has its anode connected to positive battery terminal 201. A first light emitting diode (LED) 211 has its anode connected to the cathode of diode 210. The cathode of the light emitting diode 211 is connected via a first resistor 212 to the negative terminal 202 of the auto battery 105. A second light emitting diode (LED) 213 has its anode tied to a cathode of the first LED 211. A three-positioned switch 206 has its wiper terminal connected via a second resistor 216 to the cathode of diode 210. The switch 206 has three output terminals 207, 208, and 209 respectively.

Connected to the first output terminal 207 of switch 206 is the series connection of a third resistor 215 and a second diode 217, with second diode 217 being connected with its anode tied to the third resistor 215 and its cathode tied to the cathode of the second LED 213. A fourth resistor 214 is connected between first output terminal 207 of switch 206 and the cathode of the second LED 213.

A fifth resistor 222 is connected between the wiper terminal 206 and the anode of a third LED 221. A sixth resistor 225 is connected between the primary of switch 206 and the base of a first transistor 224. A seventh resistor 234 is connected between the wiper of switch 206 and the collector of the first transistor 224. A second transistor 219 has its collector connected to the cathode of the first LED 221, and its base connected to the second output terminal 208 of the switch 206 via an eighth resistor 218. The emitter of the second transistor 219 is connected to the negative terminal 202 of the auto battery 105 via diode 223 which has its anode tied to the emitter of the second transistor 219 and its cathode tied to the negative terminal 202 of the battery 105. The third output terminal 209 of the switch 206 is connected to the negative terminal 202 of the battery 105 via an inductance component 232.

The base of first transistor 224 is connected to the negative terminal 202 of the auto battery 105 via a first capacitor 231. The emitter of the first transistor 224 is connected directly to the LED 241 which terminates outside the tester 115 in a female connector 242.

The third output terminal 209 of the switch 206 is also connected to the input of a Darlington-type operational amplifier 228. The Darlington-type operational amplifier 228 has its input tied via a ninth resistor 233 to the third output terminal 209 of the switch 206. This input to amplifier 228 is also tied via a second capacitor 230 and then a tenth resistor 229 in series, to the base of the first transistor 224. The output of the amplifier 228 is connected to the positive test probe 129 and to the wiper of the switch 206. A feedback loop from output of the amplifier 228 to a second input of that first transistor 224 is tied to the second input to the amplifier 228 via a path of a twelfth resistor 226 and then a third capacitor 227.

A fourth diode 236 and a fourth LED 237 are connected in parallel between the output of the amplifier 228 and a thirteenth resistor 223 with the anode of the fourth LED 237 in direct contact with the output of amplifier 228 and the cathode of the fourth diode 236 connected to the anode of the fourth LED 237 (diode 236 connected in reverse polarity, LED 237 connected in forward polarity). A resistor 240 is connected in parallel across the fourth diode 236. The free end of the thirteenth resistor 223 is tied to the negative terminal 202 of the battery 105 via a fourth capacitor 239 as well as to the negative probe 131. The positive probe 129 and the negative probe 131 are connected to the device to be tested 205. This device to be tested, constitutes the electronic ignition system discussed above in connection with the description of FIG. 1.

Figure 3A:
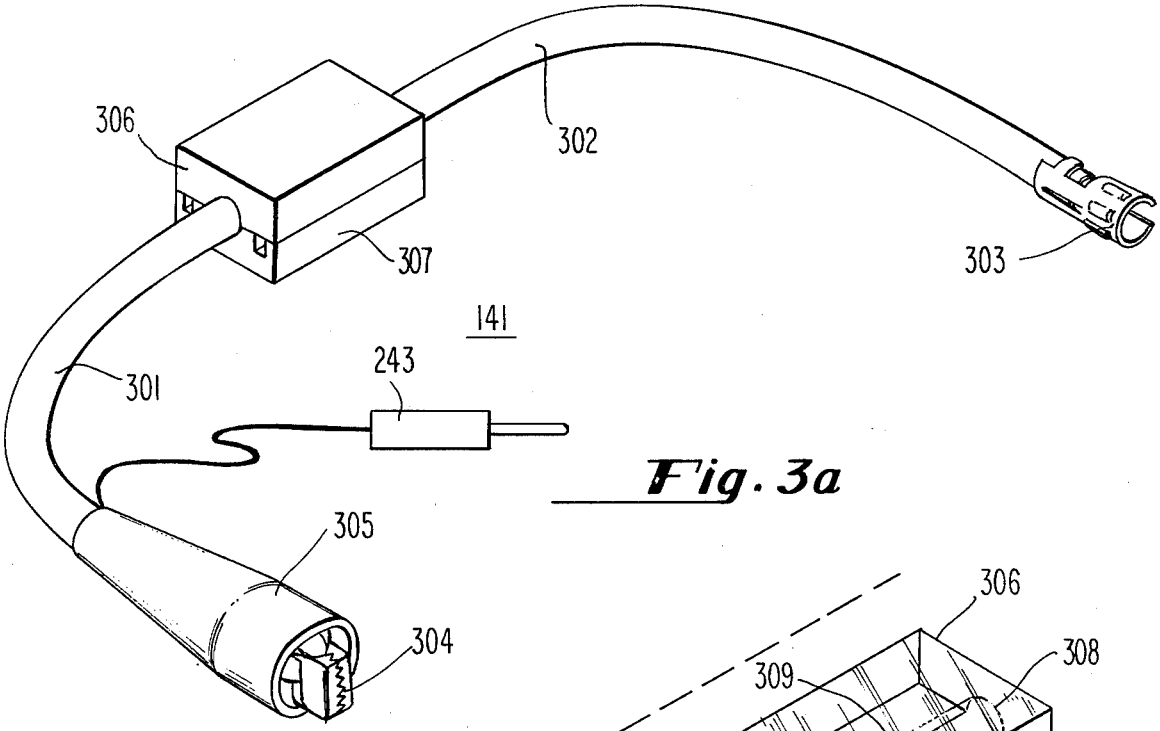
FIGS. 3*a* and 3*b* show a preferred form of the spark indicator to be utilized in conjunction with the circuitry of FIG. 2.

FIG. 3*a* illustrates the spark indicator 141 of FIG. 1. This spark indicator includes a first and second transmission cable portions 301 and 302, respectively, of a type used for spark plug wires. Connected to one end of the second transmission cable portion 302 is an annular snap-on female connector 303 of the type used to mate spark plug wires with spark plugs. Connected to one end of the first cable 301 is an allegator clip 304 surrounded by an insulating sleeve 305. The remaining free ends of the cables 301 and 302 are tied to a spark chamber having a first housing portion 306 and a second housing portion 307.

Figure 3B:
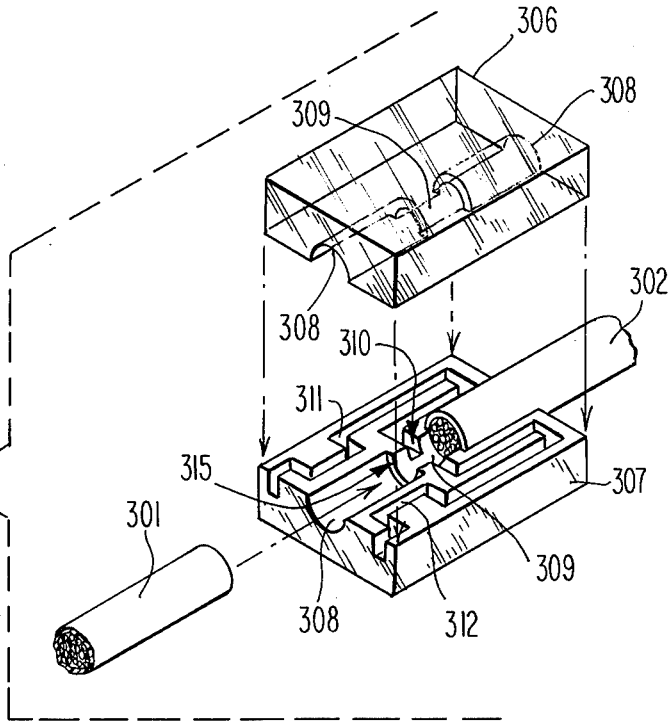

The detailed structural configuration of the spark chamber housing portions 306 and 307 are shown in FIG. 3*b*. Spark chamber first portion 306 is a rectangular piece of transparent high electrical resistence material having two relatively large opposing faces. Transcribing one of the large faces of the housing portion 306 along its center line and parallel to the edges thereof is a semi-circular canal which also cuts through the respective end faces of that housing portion 306. This semi-circular canal comprises two larger radius semi-circular portions 308 and a smaller radius semi-circular portion 309. The two larger canal portions 308 extend inwardly from the outer edges, i.e., from either end face, towards the center of the housing portion 306, the smaller canal portion 309 joins the two larger canal portions 308 to form one contiguous canal. Abutment shoulders 315 exist one each at the jointure of the canal portions 308 and 309. Mating housing portion 307 has an identical semi-circular channel including identical portions 308, 309 and shoulders 315 in the mating face with housing portion 306. With the housing portions 306 and 307 mated together a cylindrical passageway is established having a first larger outer diameter portion 308 at either end and a smaller diameter portion 309 at about the middle. The smaller inner diameter 309 being established by a shoulder 315 transition of the material. The spark plug wire portions 301 and 302 are inserted in each end respectively of the cylindrical passageway to abut against the interior shoulders 315, a precise air gap chamber is defined by the length of the inner smaller diameter channel portion 309.

Cut into either side of the channel 309 are a pair of ports 310. The ports 310 are each connected to a pair of torturous channels 311 and 312 in that channel 311 accesses port 310 and channel 312 accesses the other port 310. The channels 311 and 312, traverse, respectively, in symmetric rectilinear fashion the mating surface of the housing portion 307 to an outer face of that housing portion 307. With the housing portions 306 and 307 mated together and the spark plug wire portions 301 and 302 inserted therein, the channels 311 and 312 define twin atmospheric venting passageways for the spark chamber defined by the mating of the canal portions 309.

Figure 4:
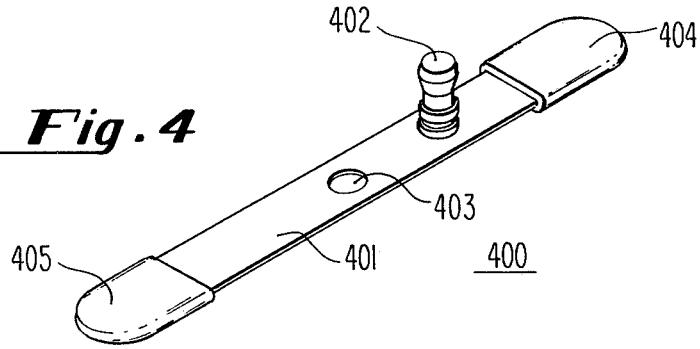
FIG. 4 shows an adapter to be used in conjunction with the spark indicator of FIGS. 3*a* and 3*b*.

An adapter 400, FIG. 4, may be needed for use with the spark indicator 141. This spark adapter includes a straight bar of metallic material 401. Attached to the face side of bar 401 is a male spark plug wire terminal 402. Situated a distance from spark plug wire terminal 402 is a hole 403 through the bar 401. Covering either end of the bar 401 are electrical insulating pads 404 and 405, respectively.

The elements discussed above in connection with FIGS. 1–4 of the preferred embodiment may be implemented with the following components:

| | |
|---|---|
| Diode 210 | 6 Amp Power Diode |

-continued

| | |
|---|---|
| Diode 217 | Type 1N 916 |
| Diode 223 | Type 1N 916 |
| Light emitting diode 211 | Monsanto type MU 5054 |
| Light emitting diode 213 | Monsanto type MU 5054 |
| Light emitting diode 221 | Monsanto type MU 5054 |
| Light emitting diode 237 | Monsanto type MU 5054 |
| Resistor 216 | 560K Ohms |
| Resistor 214 | 1K Ohms |
| Resistor 215 | 27K Ohms |
| Resistor 222 | 1K Ohms |
| Resistor 225 | 12K Ohms |
| Resistor 234 | 4.7K Ohms |
| Resistor 235 | 1.8K Ohms |
| Diode 236 | Zener 2.54 or higher |
| Resistor 226 | 560 Ohms |
| Resistor 233 | 1.5 Ohms |
| Resistor 229 | 270 Ohms |
| Resistor 238 | 100 Ohms |
| Transistor 224 | 2N 2926 |
| Transistor 219 | 2N 2926 |
| Inductor 232 | 10 m Henry |
| Capacitor 231 | 4.7MFD (Microfarads) |
| Capacitor 230 | 4.7MFD |
| Fuse | 2.5Amp Fast Blow Fuse |
| Resistor 240 | 100 Ohms |
| Capacitor 227 | 4.7MFD |
| Capacitor 239 | 4.7MFD |
| Operational Amplifier 228 | Texas Inst. T1 P105 |
| Housing Portions 306, 307 | Lexan material |
| Spark Plug Wire Portions 301, 302 | 7 Millimeter stranded steel core spark plug, silicon or hypolon insulation |
| Female Wire Terminal 303 | AMP number — ASI-332416 |
| Allegator Clip 304 | Muller number — 48-B |
| Spark Chamber Canal 309 | .200 inches long |

Probes 203 and 204 may be any of a pencil-type commonly available for use with an oscilloscope, allegator-type for use with automotive test equipment, or snap connector or spade connector-type used with auto electrical wiring.

The circuit of FIG. 2 will operate as follows. The diode 210, provides reverse polarity protection against an erroneous connection to the battery terminals 201 and 202 or to the device under test 205 with the probes 203 and 204 while diode 236 protects LED 237 against negative voltage spikes. Fuse 240 provides additional short circuit protection.

With the wiper of switch 206 connected to output terminal 207 and the positive power lead 117 of the tester connected to the positive terminal 201 of the battery 105 and the negative power lead 119 of the tester connected to the negative terminal 202 of the battery 105, and test probes 129 and 131 open, LED 221 is biased for conduction. Essentially, no current will pass through LED 213 under this operating condition as the series-parallel circuit of resistor 216 and resistors 214, 215, LED 213, and diode 217 are connected in parallel across LED 211. With the test probes 129 and 131 connected between any point in the device to be tested 205 and ground, respectively, the LED 211 will be back resistor biased by a voltage drop established across diode resistor 212 (by a current through 215 and the forward voltage drop across 217) when the voltage across the probes 129 and 131 is within one volt of the supply voltage of the auto battery 105. When there is a continuity, i.e., a nominal short, represented by a resistance of less than 5 KOhms between the probes 129 and 139, the LED 213 will conduct.

With the wiper of the switch 206 in contact with the second output terminal 208, and a nominal open circuit, i.e., a resistance greater than 50 KOhms existing between the probes 129 and 131, the second transistor 219 will switch on and the third LED 221 will be biased for conduction. With a nominal short, i.e., a resistance of less than 5 KOhms existing between the probes 129 and 131, second transistor 219 will be off and so will the third LED 221.

With the wiper of the switch 206 connected to the third output terminal 209 and LED 241 connected to ground, an oscillator defined by the first transistor 224, the twelfth resistor 226, the third capacitor 227, the test resistor 229, the ninth resistor 233, the first capacitor 231, and the inductance component 232 will be running to drive the Darlington operational amplifier 228, to provide a pulse signal at the positive probe 129. With a nominal open circuit existing between the probes 129 and 131, the fourth LED 237 will intermittently be biased for conduction.

The testing apparatus circuit of FIG. 2 with the structural and operational characteristics discussed above, can now be utilized in conjunction with the spark indicator 141 and the adapter 400 to test an electronic ignition system of the type described in FIG. 1. The adapter 400 is used for general motor systems to connect the spark indicator 141 to the secondary winding output 109 of the coil 107 where the indicator's 411 connector 303 may not be directly mated with the secondary winding output 109.

The components within an electronic ignition system can be tested in isolation from the rest of the system by disconnecting that component from the rest of the ignition system, with the exception of the 12 volt battery input connection and the ground connection, respectively, as may be needed for the test being performed. The switch 206 is intended to be operated by the mechanic performing the tests. This switch may be a slide-type switch, a rotary switch, or any other convenient type switch previously used and familiar for operation with automotive test equipment. The first, second, third, and fourth LEDs 211, 213, 221, and 237 when biased for conduction provide a light signal which is made available to the mechanic performing the test. The operation of these four lights provide a "go" "no-go" output for analyzing the results of the test conducted.

To check continuity, a nominal resistance of less than 5 KOhms must exist between any two test points of FIG. 1 when test probes 129 and 131 are applied. The switch 206 is positioned so that the wiper is in contact with the first output terminal 207. The second LED 213 is conducting and therefore is "lighted" when such a continuity exists between the test probes 129 and 131.

To check for isolation, a resistance of greater than 50 KOhms, from ground, the switch 206 is positioned with the wiper in contact with the second output terminal 208. A conduction through the third LED 221, indicated by that LED emitting light signifies an isolation or open circuit (nominally a resistance of greater than 50 KOhms) existing between the test probes 129 and 131 applied across the test point and ground.

To check voltages, the switch 206 is positioned with the wiper in contact with the first output terminal 207, and the test probes are connected with the positive probe 129 in contact with the point in question and the negative probe 131 in contact with ground. If the first LED 211 does not conduct and therefore is not lit, the voltage measured at the positive probe 129 is within one volt of the battery 105 voltage.

Individual components of the transistor ignition system of FIG. 1, can be tested for voltage levels, open circuit and short circuit conditions according to the description outlined above. However, it is also important to test the essential components such as the distributor sensor 101, the electronic control unit 103, and the ignition coil 107 under dynamic conditions. The dynamic response of each of these units is to be tested with that unit in isolation.

To test the electric distributor sensor 101 it is disconnected from the ECU 103. The output sensor signal wire 113 is connected to the positive test probe 129. With the negative test probe 131 and the sensor 101 properly grounded, and battery 105 voltage applied to the sensor coil, the tester 115 switch 206 positions with the wiper in contact with the first output terminal 207. The first and second LED lights 211 and 213 should blink indicating an effect of an apparent intermittent continuity as the distributor is rotated and the sensor provides a pulse output. The dynamic response of the distributor sensor 101 is therefore tested utilizing the dynamic continuity principles described above as applied to the sensor 101 providing an apparent continuity effect upon the tester 115.

The ignition coil 107 is dynamically tested by disconnecting the ECU 105 output to the coil 107. ECU 105 control of to coil 107 takes the form of an ECU switch interruption of the flow of current in the return connection 111 of the primary winding of the coil 107. Battery 105 supplied voltage to the positive terminal of the coil for the test. Positive test probe 129 is connected to the negative terminal return connection 111 of the coil 107. The negative test probe 131 is connected to ground. The secondary winding tower wire to the distributor 109 is disconnected from the distributor and spark indicator 141 is connected between the secondary winding output 109 and ground. With switch 206 connected, with the wiper in contact with the third output terminal 209, a substitute pulse signal is supplied by the tester. This pulse as supplied by the tester 115 is a substitute for the signal normally supplied by the electronic control unit 103. With this signal interjected into the return 111, the flow of current through the primary winding of the coil 107 is interrupted on an intermittent basis. This interruption causes a collapse of the primary field of the coil 107, which in turn creates an impulse in the secondary winding, which appears on the tower output 109 and passes through the spark indicator 141. With the tester 115 providing a repetition of the signal at about 1,000 cycles per minute, the spark indicator is fired at that repetition rate. Spark indicator 141 therefore provides a visual and audio indication of the operation and quality of the coil 107 output. At a rate of 1,000 cycles per minute, the spark exhibited by the spark indicator 141 appears to be continuous.

The dynamic response to the electronic control unit is tested by disconnecting the input from sensor 101 and substituting an input for the sensor signal. These substitute pulses are received from the testing circuitry 115 via the positive test probe 129. Positive test probe 129 is inserted into the input pin of ECU 103 which is intended to receive signals from the distributor sensor 101. The switch 206 is connected with the wiper tied to the third output terminal 209. A pulse substituting the signal normally received from the sensor 101 is generated to trigger the ECU 103. Proper dynamic response by ECU 103, i.e., response to the substitute pulses provided by the tester 115, will cause the ECU to operate with coil 107 connected to the tester 115, and a proper voltage connected thereto and the spark indicator 141 connected, arcing in the indicator 141 will indicate that the ECU 103 is working properly. An intermittent flashing of this fourth LED 237 will indicate the oscillator circuit of the tester 115 is operating properly under dynamic conditions.

The external ground connection 242 when left unconnected will prevent the flow of base current in transistor 224 and prevent the oscillator from running unless spark indicator 141 is properly grounded and the connectors 242, and 243 mated.

The oscillator in the tester 115, otherwise, will run when the ground lead 242 is connected to the spark indicator external ground connector 243. With the switch 206 connected to the third terminal 209, the positive probe 129 and LED 237 are connected into the oscillator circuit associated with transistor 224.

While the structure and operation described herein is directed to the preferred embodiment of this invention, many changes can be made in this embodiment without departing from the intent and scope thereof. It is intended, therefore, that this disclosure be taken in the illustrative sense and not in the limiting sense.

What is claimed is:

1. A testing apparatus for an electronic ignition system, this ignition system having an ignition coil with a spark output, an electronic control unit connected to said coil for controlling said coil output and an electric sensor connected to said electronic control unit for controlling said electronic control unit operation, comprising:

circuit means having a single pair of input probes one of which being the active probe and the other the ground probe for alternate connection to said electric sensor, said electronic control unit and said ignition coil for providing both static and dynamic substitute signals thereto via said pair of probes for determining via "go", "no-go" display components included therein the condition of operation, said circuit including reverse polarity protection means, and selection means whereby continuity, isolation and impedance testing can be selectively conducted; and spark indicator means connectable between said ignition coil output and ground in conjunction with said connection of said circuit means to said ignition coil for providing a signal indication of the operation of said ignition coil.

2. The apparatus of claim 1 wherein said reverse polarity protection means includes a plurality of uni-directional current valves connected within said circuit means, said valves exhibiting a display function when biased for conduction for indicating said "go", "no-go" condition; and a uni-directional current valve connected in series with one of said pair of input probes.

3. The apparatus of claim 2 wherein said uni-directional current valves are light emitting diodes.

4. The apparatus of claim 2 wherein said spark indicator means signal provided is an audio and a visual signal.

5. The apparatus of claim 4 wherein said spark indicator means includes:

means for providing an electrical connection, said means having a discontinuity creating an air gap across which flow of electric current must spark;

housing means for providing a chamber encasement around said air gap, said housing means permitting the passage therethrough of light from said air gap spark; and means located within said housing means for venting said chamber encasement to the atmosphere, said venting means including at least one port from said chamber encasement and a tortuous passageway extending therefrom to an outer surface of said housing means.

6. The apparatus of claim 5 wherein said spark indicator means includes an adapter usable to electrically mate with said spark indicator connector means and said coil output, said adapter including a bar of electrically conductive metallic material, a male wire terminal attached to a face thereof at one end, matable with said spark indicator connection means, a hole through said bar at the other end, and electrical insulating pads covering both ends of said bar.

7. The apparatus of claim 6 wherein said spark indicator venting means includes:

a pair of ports accessing said chamber encasement one on either side thereof; and a pair of passageways, extending one each from each port through said housing means to an outer surface thereof to vent said chamber encasement, each said passageway traversing a rectalinear pathway.

8. An apparatus for testing an electronic ignition system, which system includes an ignition coil for delivering ignition current, said coil having primary and secondary windings, an electronic control unit connected for pulsed operation of said ignition coil, an electric sensor connected to actuate said electronic control unit, and a battery to power said ignition system, said testing apparatus comprising:

ignition current indicator means for rendering an audio-visual indication of said ignition coil delivered ignition current, said indicator means being connectable to said ignition coil secondary winding and containing a predetermined fixed air gap established by the distance between a pair of abuttment shoulders thereof;

a pair of electrical connections connectable across said battery;

reverse polarity protection means connected in series with one of said electrical connections; and circuit means including an oscillator and a pair of test probes for selectively performing static circuit tests and dynamic circuit tests, said circuit means being connected to said pair of electrical connections.

9. Apparatus for testing of components of an electronic ignition system, which system includes an ignition coil for delivering ignition current, said coil having a primary and a secondary winding, an electronic control unit connected to pulse operate said ignition coil, an electric distributor sensor connected to actuate the pulse operation of said electronic control unit and a battery to power the operation of said system components and battery connections, the input and output terminals of each component and ground being defined as test points of said system, said testing apparatus comprising:

a pair of power leads suitable of respective connection to the positive and negative terminals of said battery, one of said battery terminals being connected to ground;

a pair of test probes being suitable of respective connection to said system test points, one of said test probes being designated as common and connected with said power lead connected to ground;

means for providing reverse polarity protection, said reverse polarity protection means being series connected into said power lead not connected to ground;

a switch operable to a plurality of alternative positions to select alternative continuity, isolation and impedance tests; and a plurality of electric subcircuits each capable of performing at least a different one of said alternative tests, said subcircuits each containing current polarity components including light emitting diodes, the energization of which indicating a "go", "no-go" display of a test result, each said light emitting diode turn on voltage being an integral part of each said subcircuit test operation as well as display operation, said subcircuits each being connected at a node with said common test probe, and alternatively, with the other power lead and the other test probe through said switch.

10. The apparatus of claim 9 wherein said plurality of said subcircuits is three and wherein said plurality of alternative switch positions is three.

11. The apparatus of claim 10 wherein said first subcircuit includes a first light emitting diode being energized when said power leads are connected to said battery in proper polarity, said switch being in said first position, said first light emitting diode being connected in series with a first resistance across said power leads.

12. The apparatus of claim 11 wherein said first subcircuit also includes a second light emitting diode being energized when the resistance circuit appearing between said test probes is less than 5 KOhms, said second light emitting diode being connected in reverse polarity from said connection point of said first light emitting diode and said first resistance, a second resistance connected in series with said second light emitting diode to said first switch position, and a first diode connected in series with a third resistance across the series connection of said second light emitting diode and said second resistance.

13. The apparatus of claim 12 wherein said second subcircuit includes a third light emitting diode being energized when said switch is in said second position and the resistance appearing between said test probes is greater than 50 KOhms, said second subcircuit including:

a transistor switch;

said third light emitting diode being connected in forward polarity to the cathode of said transistor;

a fourth resistance connected between said other test probe and said third light emitting diode;

a fifth resistance connected between said second switch position and said transistor base; and a second diode connected forward polarity between said transistor emitter and said common test probe.

14. The apparatus of claim 13 wherein said third subcircuit includes an oscillator and a fourth light emitting diode, said oscillator being operative for producing pulses to said other probe when said switch is in said third position, said fourth light emitting diode being intermittently energized when an intermittant apparant resistance occurs across said test probes, said fourth light emitting diode being connected in a forwardly biased connection from said other probe; a sixth resistance being connected in series with said fourth light emitting diode; and a capacitance being connected between said sixth resistance and said common probe.

* * * * *